United States Patent [19]

Herold et al.

[11] 4,288,893

[45] Sep. 15, 1981

[54] METHOD OF COOLING STUFFER CRIMPED YARN

[75] Inventors: Heiko Herold, Neuss; Richard Herold; Rudolf J. Klee, both of Dormagen; Edgar Muschelknautz, Leverkusen, all of Fed. Rep. of Germany

[73] Assignee: Bayer Aktiengesellschaft, Leverkusen, Fed. Rep. of Germany

[21] Appl. No.: 13,895

[22] Filed: Feb. 22, 1979

[30] Foreign Application Priority Data

Feb. 22, 1978 [DE] Fed. Rep. of Germany ..... 2807490

[51] Int. Cl.[3] ..... D02G 1/12

[52] U.S. Cl. ..... 28/266

[58] Field of Search ..... 28/255, 256, 257, 266

[56] References Cited

U.S. PATENT DOCUMENTS

| | | | |
|---|---|---|---|
| 3,007,226 | 11/1961 | Becker et al. | 28/266 |
| 3,058,167 | 10/1962 | Rainard et al. | 28/266 |
| 3,166,820 | 1/1965 | Taul et al. | 28/266 |
| 3,174,208 | 3/1965 | Saito et al. | 28/266 |
| 3,372,446 | 3/1968 | Shichman et al. | 28/256 |
| 4,014,084 | 3/1977 | Bauer et al. | 28/255 |
| 4,040,154 | 8/1977 | Riley | 28/257 |
| 4,103,404 | 8/1978 | Backer et al. | 28/255 |
| 4,115,989 | 9/1978 | Spolnicki | 28/257 X |

*Primary Examiner*—Robert Mackey

*Attorney, Agent, or Firm*—Sprung, Felfe, Horn, Lynch & Kramer

[57] ABSTRACT

A liquid jet, which is not decomposed to droplets, is guided onto a hot yarn wad in a cooling section with rod guide means, and this leads to rapid, very uniform cooling. Smooth thread travel is produced during take-off at thread speeds of 2000 m/min and more. One deflection of the thread is usually sufficient for drying purposes since the liquid is thereby centrifuged off.

2 Claims, 1 Drawing Figure

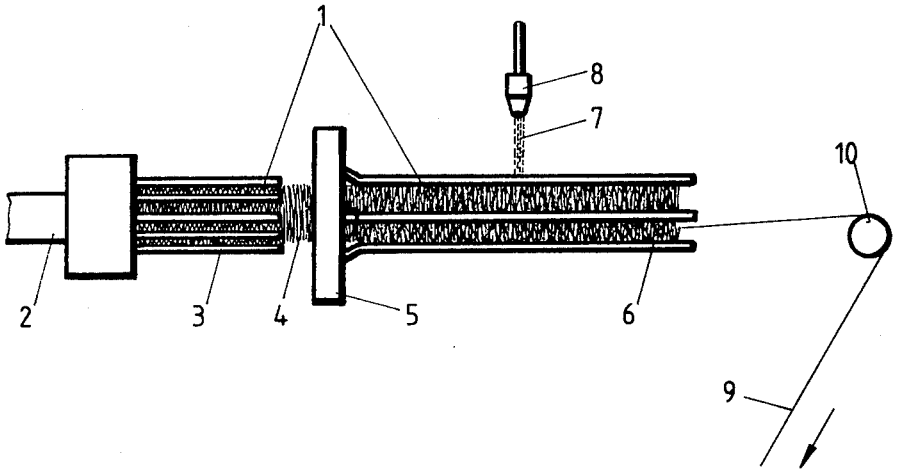
1
8
7
10
2
3
4
5
6
9

METHOD OF COOLING STUFFER CRIMPED YARN

A method in which a hot yarn wad is cooled in a rod guide by blowing air through it is described in German Offenlegungsschrift No. 2,053,354. The method is not very flexible, the frictional behaviour of the wad changes when the temperature of treatment or the thickness of the thread are changed, and the temperature profile is irregular.

In an apparatus described in German Offenlegungsschrift No. 2,236,024, the hot wad is deposited on moving sieves or belts. The wad is wetted with a finely sprayed, liquid mist, since it is not guided laterally. The thread has to be dried prior to winding. The stopper frequently unravels not at the end but at weak points which have not been sufficiently cooled.

An object of the invention is to develop an economical method of cooling a yarn wad, in which the wad is cooled uniformly and which produces smooth travel of the filament during the take-off operation. This object is achieved in that the wad is pushed through a cooling section having rod guide means, a liquid jet, which is not decomposed to droplets, is guided onto the yarn wad inside this region, and the yarn is deflected from the wad during the take-off operation.

The dry hot wad is guided and held by at least three elastic rods in the cooling section. It is struck by one or more cold liquid jets, which are not decomposed to droplets, in this region and is effectively cooled uniformly over its entire cross-section. The yarn wad issuing from the cooling section is so uniform in its structure that when the thread is taken off, the thread at the end of the wad unravels and the wad is not stretched owing to internal defective points. This guarantees smooth thread travel. The still wet thread which has been taken off is sharply deflected so that the liquid is thereby centrifuged off by centrifugal forces. It is therefore not necessary to specially dry the thread again. The liquid need not be atomised, owing to the rod guide in the cooling section, but can instead act on the wad as a jet.

It is particularly advantageous if the yarn wad is moved through a cooling section having a rod guide which does not contact the hot stuffer section. Heat transfer from the stuffer section to the cooling section is thus avoided and the method according to the invention is even more effective. It is necessary to provide at least three elastic rods clamped at one end only at the beginning of the cooling section in order to guide the stopper in the cooling section. The rods contribute to the fact that the wad only becomes loose at its end.

It is surprising that a non guiding space can be present between the stuffer section and cooling section. The interval can be up to five times the wad diameter without it being necessary to provide special guide means for the stopper. With such an interval, the wad does not buckle when introduced into the cooling section.

The method is suitable for the high take-off speeds which are normal nowadays. The filament yarn can be drawn-off with smooth thread travel at speeds of 2000 m/min and more.

The parameters of the texturing nozzle, for example pressure and temperature, are advantageously regulated in such a way that the end of the uncooled wad moves in the direction of travel and that of the cooled wad moves against the direction of travel of the thread. The liquid jet then invariably strikes the end of the wad. If several texturing devices are connected in parallel, the residence times in the individual temperature zones can be desiged to be of exactly equal length.

The drawing shows, by way of example, an apparatus for carrying out the method. The filament yarn 1 is stuffed into a texturing nozzle 2 and guided by rods 3 which are fixed at the outlet of the texturing device. It then passes into a cooling section which is not connected directly to the texturing device in this case. The hot yarn wad is not guided in the gap 4, and no resulting disturbance was observed. The cooling section consists of a holder 5 on one side of which four elastic rods 6 are fixed. The area between the rods 6 is larger than or equal to the area of the stuffer section of the texturing nozzle. A liquid jet 7 which issues from the nozzle 8 cools the yarn wad rapidly and uniformly. The texturing device is adjusted in such a way that the stopper begins to unravel at the point when no more liquid strikes the wad. The thread 9 is taken off and, in the process, is sharply deflected by the roller 10. A virtually dry thread can be wound.

EXAMPLE

A wad of 4 mm in diameter is formed when a polyester thread of 200 dtex/34 f is textured. It has a temperature of 160° C. before entering the cooling section. The water issuing from a nozzle with a bore of 0.5 mm cools the wad uniformly to 70° C. The thread is deflected by 280° via a pin having a diameter of 6 mm. In this example, 3 kg of filament yarn are processed per hour.

What we claim is:

1. In process of texturizing yarn wherein yarn at an elevated temperature is formed into a wad in a stuffer section including an array of rod guide means and thereafter cooled, the improvement for cooling said yarn wad which comprises passing without guiding support said wad into a cooling section which cooling section is not directly connected to said stuffer section, pushing said wad through said cooling section equipped with an array of rod guide means, directing onto said wad a liquid jet which does not decompose to droplets while said wad is in said cooling section, thereafter removing yarn from said wad and deflecting the yarn as the same is removed from said wad to centrifuge liquid therefrom whereby a virtually dry yarn may be wound.

2. A process according to claim 1 wherein said rod guide means are elastic.

* * * * *